US007639824B2

(12) United States Patent
Franzén

(10) Patent No.: US 7,639,824 B2
(45) Date of Patent: Dec. 29, 2009

(54) NOISE DAMPING HEADSET WITH A THROAT MICROPHONE

(76) Inventor: Bo Franzén, Södra Sävsjö 417, S-382 94, Nybro (SE)

( * ) Notice: Subject to any disclaimer, the term of this patent is extended or adjusted under 35 U.S.C. 154(b) by 326 days.

(21) Appl. No.: 10/570,679

(22) PCT Filed: Sep. 3, 2004

(86) PCT No.: PCT/SE2004/001275

§ 371 (c)(1),
(2), (4) Date: Apr. 18, 2006

(87) PCT Pub. No.: WO2005/025268

PCT Pub. Date: Mar. 17, 2005

(65) Prior Publication Data

US 2006/0239489 A1 Oct. 26, 2006

(30) Foreign Application Priority Data

Sep. 4, 2003 (SE) ..... 0302404

(51) Int. Cl.
*H04R 25/00* (2006.01)

(52) U.S. Cl. ..... 381/151; 381/380

(58) Field of Classification Search ..... 379/430; 181/135; 381/72, 74, 151, 326, 328, 370, 381/374, 380

See application file for complete search history.

(56) References Cited

U.S. PATENT DOCUMENTS 2,165,124 A * 7/1939 Ballantine ..... 381/151
2,487,038 A * 11/1949 Baum ..... 181/135
2,824,558 A * 2/1958 Michael et al. ..... 181/135
3,136,854 A * 6/1964 Willick ..... 379/430
5,251,326 A * 10/1993 Silverman ..... 381/380
6,129,175 A 10/2000 Tutor et al. ..... 181/135
6,519,345 B1 * 2/2003 Yang ..... 381/380

FOREIGN PATENT DOCUMENTS

| | | |
|---|---|---|
| DE | 299 03 048 U1 | 6/1999 |
| FR | 2559984 A1 | 8/1985 |
| GB | 695326 | 8/1953 |
| GB | 21632625 A1 | 2/1986 |
| RU | 2177675 C2 | 3/1999 |

OTHER PUBLICATIONS

International Search Report PCT/SE2004/001275 dated Nov. 30, 2004.

* cited by examiner

*Primary Examiner*—Brian Ensey
(74) *Attorney, Agent, or Firm*—Ostrolenk Faber LLP

(57) ABSTRACT

The invention relates to a noise damping headset comprising at least one microphone and at least one ear phone intended to be connected via electrical conduits, preferably wires, to a transmitter and a receiver, preferably a mobile telephone, a communication radio or the like for communication between persons. The microphone consists of throat microphone for direct or indirect contact against the skin around a throat, the equipment mainly being sound tightening for sounds, coming from outside, from emerging into the throat microphone and the ear phone comprises a funnel-shape for inserting the same into the auditory canal of a person's ear, the outer limiting surfaces of the funnel-shape being sound tightening against the walls of the auditory canal, the sound coming from outside being prevented from emerging into the auditory canal, whereby a communication between said persons can be held without being disturbed in a greater extent of the sound coming from outside.

8 Claims, 2 Drawing Sheets

NOISE DAMPING HEADSET WITH A THROAT MICROPHONE

CROSS REFERENCE TO RELATED APPLICATION

The present application is a 35 U.S.C. §§ 371 national phase conversion of PCT/SE2004/001275, filed Sep. 3, 2004, which claims priority of Swedish Application No. 0302404-9, filed Sep. 4, 2003. The PCT International Application was published in the English language.

BACKGROUND OF THE INVENTION

The present invention relates to a noise damping headset intended to be connected via electrical conduits to a mobile telephone or a communication radio for communication between persons. The headset comprises a throat microphone, which is tight against sound coming from outside, and at least one ear phone, which is tight against the walls of the auditory canal, so that sounds coming from outside are substantially prevented from entering into the auditory canal of an ear, so that a communication between said persons can be held without being disturbed by the sound coming from outside.

In connection to the devices present on the market today noise damping "headsets" are used in order to communicate with persons in a working place or between people in vehicles, such as tractors, cars, motor bikes, and so on, via one or more communication radios or via mobile telephones. These headsets are made as receivers, which surround the outer ears of a person, in order to stop noise coming from outside. The receivers are made of a sound insulating material. Owing to this, most of the noise coming from outside leaks into the auditory canal of the ear. The receivers are connected by a spring clamp extending over the head. A microphone is fixed to the receivers or the clamp via an arm, so that the microphone is located near the mouth of the user during the use of the noise damping headset. A substantial amount of the noise coming from outside emerges into the microphone and disturbes the communication. It is previously known to put in ear phones with a funnel-shape having wings for its fixing into the ear without using a clamp. If such structures are used, one certainly receive a tightening of the sound coming from outside but the microphone leaks in too much of this sound. Thus this solution still does not function. One device uses built in ear phones and microphone in a helmet intended to be used at working places and said vehicles. In this device too much of the sound coming from outside leaks in. Between people on motorbikes no communication can be made at speeds over 50 to 70 km/hour, mostly because of the sound coming from outside leaking into the microphone but also because the ear phones in the helmet are also sound-leaking.

SUMMARY OF THE INVENTION

The object of the present invention is to solve the problems mentioned above by using ear phones and throat microphones which are mainly tight for sound coming from outside.

Thanks to the invention a noise damping headset has now been provided, which comprises a microphone and ear phones, which are connected via electrical conduits such as wires to a mobile telephone or a communication radio for communication between persons. The microphone includes a throat microphone for contacting the skin around a throat, so that the structure is mainly sound-tight against sound coming from outside to prevent it from leaking into the throat microphone. In providing the ear phone with a funnel-shape, which is inserted into the auditory canal of the ear, the outer limiting surfaces of the funnel-shape are connected with the walls of the auditory canal and are sound tightening in this way against the sound coming from outside to prevent it from leaking into the auditory canal and further into the inner ear. When both the throat microphone and the ear phones are thus sound insulated from sound coming from outside, a communication between the persons can be made without being disturbed in a greater extent of the sound coming from outside. In a preferred embodiment example of the invention, the funnel-shape is provided with at least one surrounding wing, which functions as a sound tightening joint or as a fastening element. In this case, the ear phone is fixed in the auditory canal at the same time as the fastening element is sound-tightens better against the walls of the auditory canal, so that sound coming from outside in a better way is kept outside the ear phone. In an alternative embodiment example of the invention, the throat microphone is equipped so that the microphone itself is fixed in a cap and turned to a direction towards the skin around the throat and in that place cast in the surrounding silicone, so that the sound coming from outside has difficulty to emerge through the surrounding silicone. In order to get a good contact of the throat microphone against the skin around the throat, the throat microphone is fixed to a clamp, which is resilient so that the clamp can be biased around e.g. the neck of a person, throat or other part of the body, so that a better tightening at the tightening collar is provided. The throat microphone can of course be fixed against the skin by aid of a tape or by aid of a connected rubber strip or a connected strip intended to be tied around any part of the body. The greatest advantages with the invention are that a noise damping headset has been created, which substantially stops sound coming from outside to emerge into the auditory canal, so that a communication between persons can be performed without being disturbed in any greater extent also during high noise levels. Further the headset is very light and takes little place and is also cheep to manufacture. It can be used in ordinary protecting helmets and MC-helmets, which also gives a great economical saving. During a communication the person, who is talking and listening in the headset speaks at a much lower loudness level, so that persons located nearby are not disturbed.

BRIEF DESCRIPTION OF THE DRAWINGS

The invention will be described in more detail below by aid of some preferred embodiment examples with reference to the drawings enclosed, in which.

DESCRIPTION OF A PREFERRED EMBODIMENT

Figure 1:
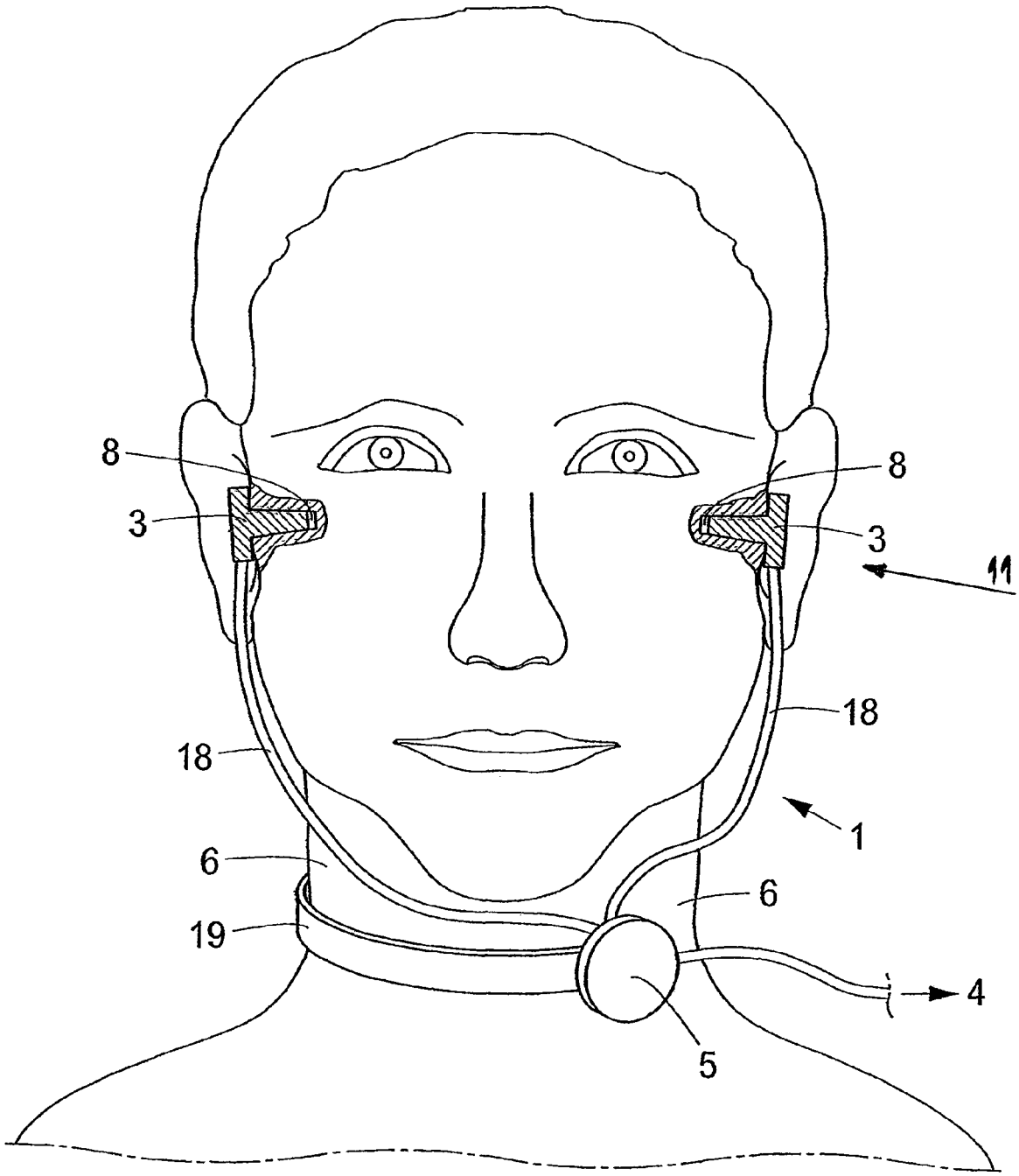
FIG. 1 illustrates a partly transluced perspective view of a head of a person using a headset.

As can be seen from FIG. 1, a person is illustrated equipped with a noise damping headset 1 comprising two earphones 3, inserted into auditory canals 8 and fixed in a sound tightening way, so that sound 11 coming from outside does not emerge into the auditory canal 8, and a throat microphone lying in contact with the skin around the throat 6. The earphones 3 and the throat microphone are connected via conduits 18 to a transmitter and a receiver 4. The throat microphone 5 is fixed to a clamp 19. The contact against the throat 6 sound-tightens from the sound 11 coming from outside to emerge into the throat microphone 5.

Figure 2:
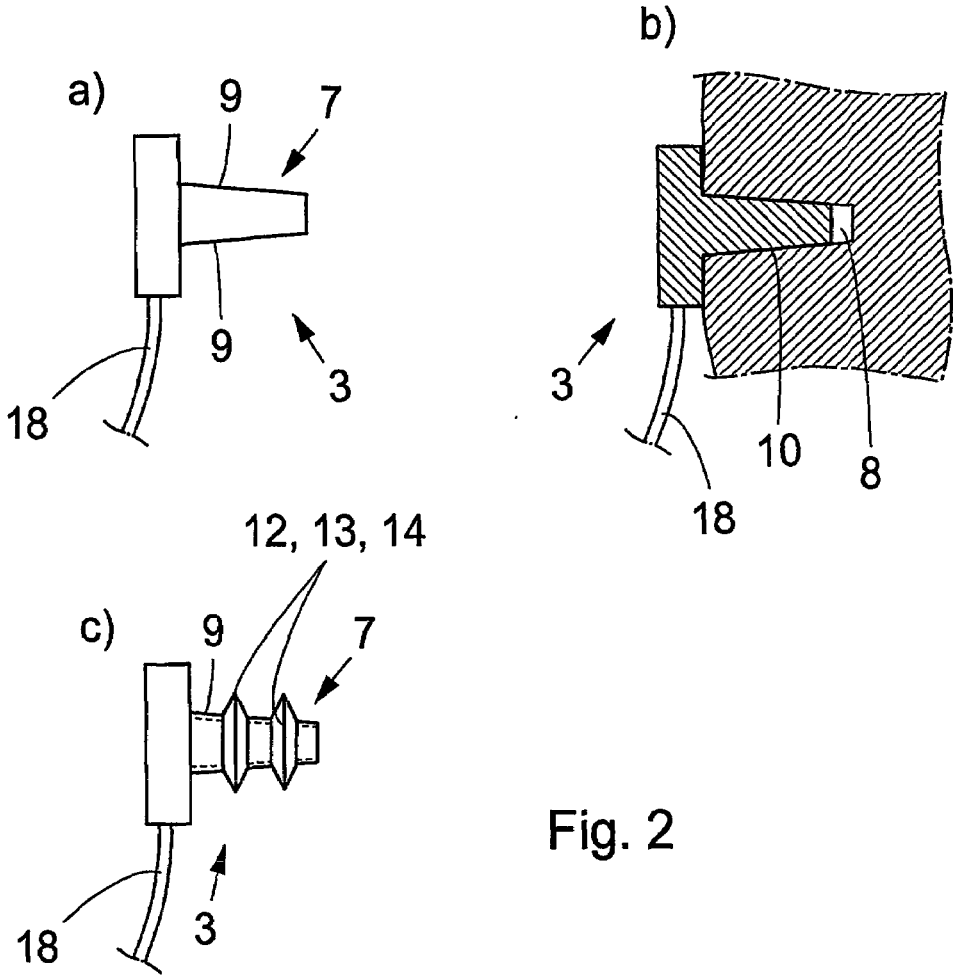
FIG. 2 illustrates in a part view a) an earphone having a funnel shape in a side view before said funnel shape is inserted into the auditory canal. The part view c) illustrates the funnel shape in a vertical section after having been inserted into the auditory canal. The part view c) illustrates an alternative embodiment example av said funnel shape in a side view before the same has been inserted into the auditory canal.

In FIG. 2, it is illustrated in a part view a) the ear phone 3 having a funnel shape 7 with outer limiting surfaces 9, which are to be positioned in a continuous contact with the walls 10 of the auditory canal 8 to sound-tighten the ear phone against the walls 10 of the auditory canal 8. In part view b), the ear phone 3 is illustrated when the same is inserted into the auditory canal 8. In part view c), the limiting surfaces 9 are completed with surrounding wings 12, which consist of a sound tightening joint 13 or of a fixing element 14.

Figure 3:
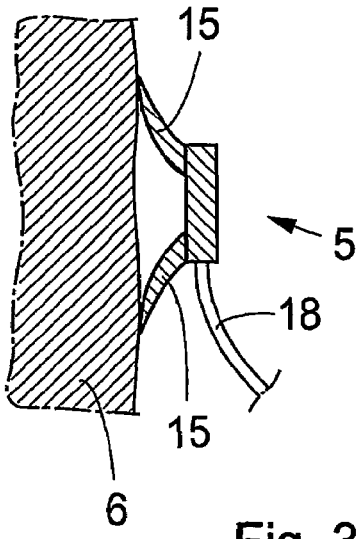
FIG. 3 illustrates a throat microphone in a vertical section and which is lying in contact with the skin around a throat and FIG. 4 illustrates a throat microphone in a vertical section lying in contact with the skin around a throat having a directed microphone.

In FIG. 3 a throat microphone 5 is illustrated having a tightening frustoconical flange or collar 15, which for better tightening against the skin around a throat 6 has a gradually expanding inner diameter and is opened towards the wearer's skin.

Figure 4:
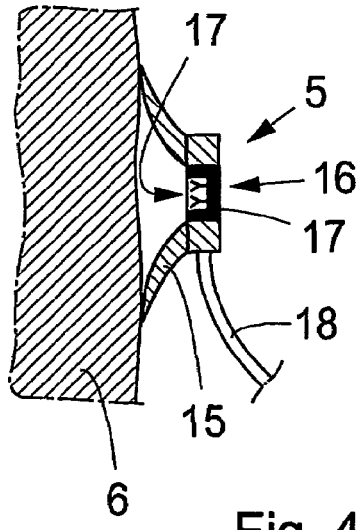

In FIG. 4, the throat microphone 5 is illustrated as formed with a cap 16, in which a microphone 17 directed towards the skin around the throat 6 is cast in the surrounding silicone.

The invention claimed is:

1. A noise damping headset comprising:

at least one throat microphone of a wearer's throat, the throat microphone being configured to prevent outside sound from leaking into the microphone, the throat microphone including a tightening frustoconical flange having a gradually expanding inner diameter such that an area with a largest inner diameter is open in a direction of the wearer's throat and is positioned against the wearer's throat to tighten a contact between the throat microphone and the wearer's throat;

at least one earphone having a funnel-shaped body with outer limiting surfaces, the earphone being configured for insertion into an auditory canal of a wearer's ear, such that the outer limiting surfaces of the funnel-shaped body of the earphone are positioned in a continuous tight contact against walls of the auditory canal to prevent outside sound from leaking into the auditory canal; and an electrical conduit operable to connect the throat microphone and the earphone to a communication device.

2. A headset according to claim 1, wherein the funnel-shaped body of the earphone includes at least one surrounding wing shaped and operable to secure the earphone within the auditory canal and to further tighten the earphone against the walls of the auditory canal.

3. A headset according to claim 1, further comprising a cap having a silicone material placed therein, the throat microphone being cast in the silicone material.

4. A headset according to claim 1, wherein at least one of the earphone and the throat microphone is fixed in a clamp.

5. A headset according to claim 2, wherein the surrounding wing comprises a rubber material.

6. A headset according to claim 1, wherein the tightening frustoconical flange comprises is a rubber material.

7. A headset according to claim 1, further comprising a resilient clamp, the throat microphone being fixed in the clamp wherein the clamp is operable to pressing the throat microphone towards the skin around the throat.

8. A headset according claim 1, wherein the throat microphone is fixed to the skin around the throat by one of a tape, a connected rubber strip and a connected strip tied around a body part.

* * * * *